US005595087A

United States Patent [19]

Harsch

[11] Patent Number: 5,595,087

[45] Date of Patent: Jan. 21, 1997

[54] APPARATUS FOR THE TRANSPORT OF PARTS IN A MULTIPLE-DIE PRESS

[75] Inventor: Erich Harsch, Weingarten, Germany

[73] Assignee: Maschinenfabrik Mueller-Weingarten AG, Weingarten, Germany

[21] Appl. No.: 533,673

[22] Filed: Sep. 26, 1995

Related U.S. Application Data

[63] Continuation of Ser. No. 207,713, Mar. 9, 1994, abandoned.

[30] Foreign Application Priority Data

Apr. 23, 1993 [DE] Germany ..... 43 13 416.5

[51] Int. Cl.[6] ..... B21D 43/05

[52] U.S. Cl. ..... 72/405.16; 72/405.13

[58] Field of Search ..... 72/405.16, 405.13, 72/405.12, 405.11, 405.1, 405.09, 405.01; 198/621.1–621.4

[56] References Cited

U.S. PATENT DOCUMENTS

| | | | |
|---|---|---|---|
| 4,693,361 | 9/1987 | Baba | 72/405 |
| 4,697,449 | 10/1987 | Harsch | 72/405 |
| 4,753,103 | 6/1988 | Braun | 72/405.11 |

FOREIGN PATENT DOCUMENTS

| | | | |
|---|---|---|---|
| 2718646 | 11/1978 | Germany . | |
| 3537269 | 4/1987 | Germany | 72/405 |
| 3712838C2 | 11/1988 | Germany . | |
| 163038 | 9/1984 | Japan | 72/405 |
| 101636 | 6/1987 | Japan | 72/405 |
| 295620 | 12/1990 | Japan | 72/405 |

*Primary Examiner*—Daniel C. Crane
*Attorney, Agent, or Firm*—Spencer & Frank

[57] ABSTRACT

An apparatus for the transport of parts in a multiple-die press is proposed, in which transverse arms supporting the workpiece are provided, which transverse arms are disposed longitudinally displaceably and pivotably on gripper rails.

14 Claims, 5 Drawing Sheets

APPARATUS FOR THE TRANSPORT OF PARTS IN A MULTIPLE-DIE PRESS

This application is a Continuation of application Ser. No. 08/207,713, Filed Mar. 9, 1994, now abandoned.

BACKGROUND OF THE INVENTION

The invention relates to an apparatus for the transport of parts in a multiple-die press, having a plurality of die stages. The apparatus comprises a plurality of spaced apart gripper rails movable in three dimensions and extending respectively in a longitudinal direction through the die stages. At least one tong is fastened to one of the gripper rails and projects in a direction essentially perpendicular to the longitudinal direction of such rail for supporting a portion of a workpiece and for moving the workpiece from one die stage to another die stage.

DE 37 12 838 C2 has disclosed an apparatus for removing double parts from the last die stage of a multiple-die press, in which the parts are transported from die stage to die stage by tongs fastened to three-dimensionally movable gripper rails. In this document, it is stated that workpieces are produced as double parts in a multiple-die press and that these double parts are not separated until the last die stage. Since these parts are only laterally held by tongs of the gripper rails, they are no longer able to be properly transported once the respective double part has been severed. It is therefore necessary for the double part which has been severed in the last die stage to receive, in onward transportation, an additional support to prevent the part from sagging. To this end, the known apparatus proposes a cross-tie between the gripper rails, on which cross-tie there is disposed, in the region of the dividing point, an extension arm at the end of which is provided an additional part support. The part support is herein also able to perform, by means of guide blocks, an upward and downward motion in order to under-grip the workpiece for transportation.

German Offenlegungsschrift 27 18 646 has further disclosed a workpiece transporting apparatus, in which an additional workpiece support likewise takes place. The primary function of the workpiece support is not to prop up severed double parts, but to support relatively wide workpieces at high working speeds in order to prevent the workpieces from fluttering.

The difference in this known device compared with the first-named apparatus lies in the arrangement of a supporting slide, which is disposed between the gripper tongs and such that it operates parallel to these. A longitudinal displacement of the supporting slide, i.e. a motion transverse to the direction of transport of the parts, is herein envisaged, in order to position the supporting slide between the gripper tongs beneath the workpiece. Using a device of this kind, a divided double part can also, where necessary, be propped up.

SUMMARY OF THE INVENTION

The object of the invention is to refine an apparatus for the transport of parts in a multiple-die press such that a very simple supporting facility for the workpiece is rendered possible, as this is transported within the press. The transporting device should herein be designed to be as simple and operationally reliable as possible and to have a low weight.

This is achieved by providing the apparatus with at least one arm fastened to the gripper rail to which the tong is fastened. The arm projects transversely from the gripper rail for supporting the workpiece at a position distal from the portion supported by the tong in a direction toward the other gripper rail. The arm is movable relative to at least one of the respective gripper rail and the workpiece.

The apparatus according to the invention has the advantage over the known devices that a transport system, which is as simple as possible, yet very flexible, is created, which is suitable, in particular, for use in the transport of double parts divided in the last die stage. By means of the apparatus according to the invention, even double parts having very different outer contours can be particularly easily lightly grasped, since the additional transporting device is of very flexible and universal configuration in terms of the workpiece support.

The central concept behind the transporting apparatus according to the invention is that the parts to be transported should be supported as close as possible to their dividing point. To this end, a simple transverse arm is envisaged, which originates from the gripper rail, juts into the working chamber or die stage and, by means of an extension arm running in the longitudinal direction of the press, under-grips the workpiece to be supported. A relative motion herein takes place between the gripper rail and the additional transporting apparatus, in order to under-grip the workpiece.

The very simple configuration of the holding shoe under-gripping the workpiece and of its fastening on that part of the gripper rail which can be uncoupled when a die is changed, makes it possible, when changing the parts or the associated dies, for these prop-up parts under-gripping the workpiece also to be very easily exchanged. Furthermore, the transporting apparatus also exhibits very small, movable weights, which give rise to low vibration characteristics in the transfer system.

The apparatus according to the invention is particularly suitable for supporting the double parts, which are separated in the last die stage, in the onward transportation of these workpieces. It can however also be used in other die stages to under-grip superficially large parts in order to prop them up. In this case the apparatus according to the invention, whenever a die is changed, can always be withdrawn from the die chamber by means of sliding tables and changed together with the altered dies.

Particularly advantageously, the apparatus according to the invention is configured having a transverse arm fastened to a longitudinal guide or curved guide on the gripper rail, the transverse arm being movable relative to the gripper rail in the horizontal and vertical direction of the multiple-die press.

An alternative embodiment to this envisages that the transverse arm is connected immovably to the gripper rail and that the extension arm running in the longitudinal direction of the press performs a uniaxial or biaxial motion in order to reach beneath the workpiece with its holding or supporting shoe.

Expediently, the transporting apparatus is configured such that opposing transverse arms are fastened to the opposing gripper rails and jut transversely into the press chamber as far as is necessary to support the parts. Of course, a single arm can also be provided, which extends beyond at least the center line of the press and exhibits corresponding means to enable it to under-grip the single parts.

The transverse arms can also of course be telescopically configured to enable them to jut variably in length into the press chamber. An optional adaptation to different workpieces can thereby be obtained. In general however, the transverse arms, whenever a die is changed, are withdrawn from the press chamber by means of the sliding tables and exchanged in a manner specific to the workpiece.

BRIEF DESCRIPTION OF THE DRAWINGS

Further details and advantages of the invention are derived from the drawings representing an illustrative embodiment, which drawings are described in greater detail in the following description and in which.

DESCRIPTION OF THE INVENTION

The illustrative embodiment of the invention relates to a multiple-die press as described in Patent Specification No. 37 12 838, mentioned in the introduction, of the applicant. Reference is herewith expressly made to the content of this patent specification in order to describe a multiple-die press according to the present invention. Reference is equally made to the there-discussed problem of removing double parts from the last die stage.

Figure 1:
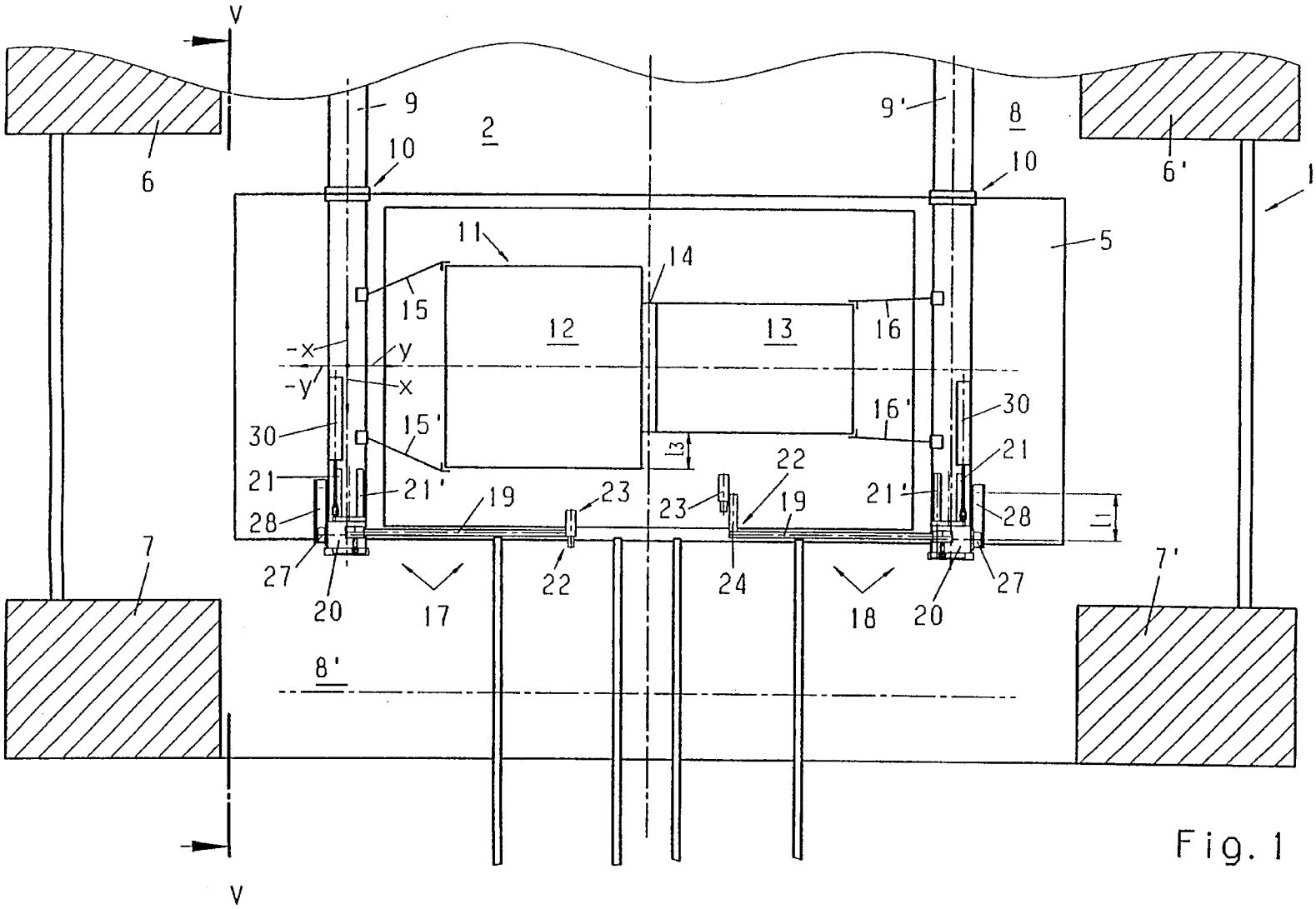
FIG. 1 shows the last die stage displaying the apparatus according to the invention in top view in the initial setting.
Figure 2:
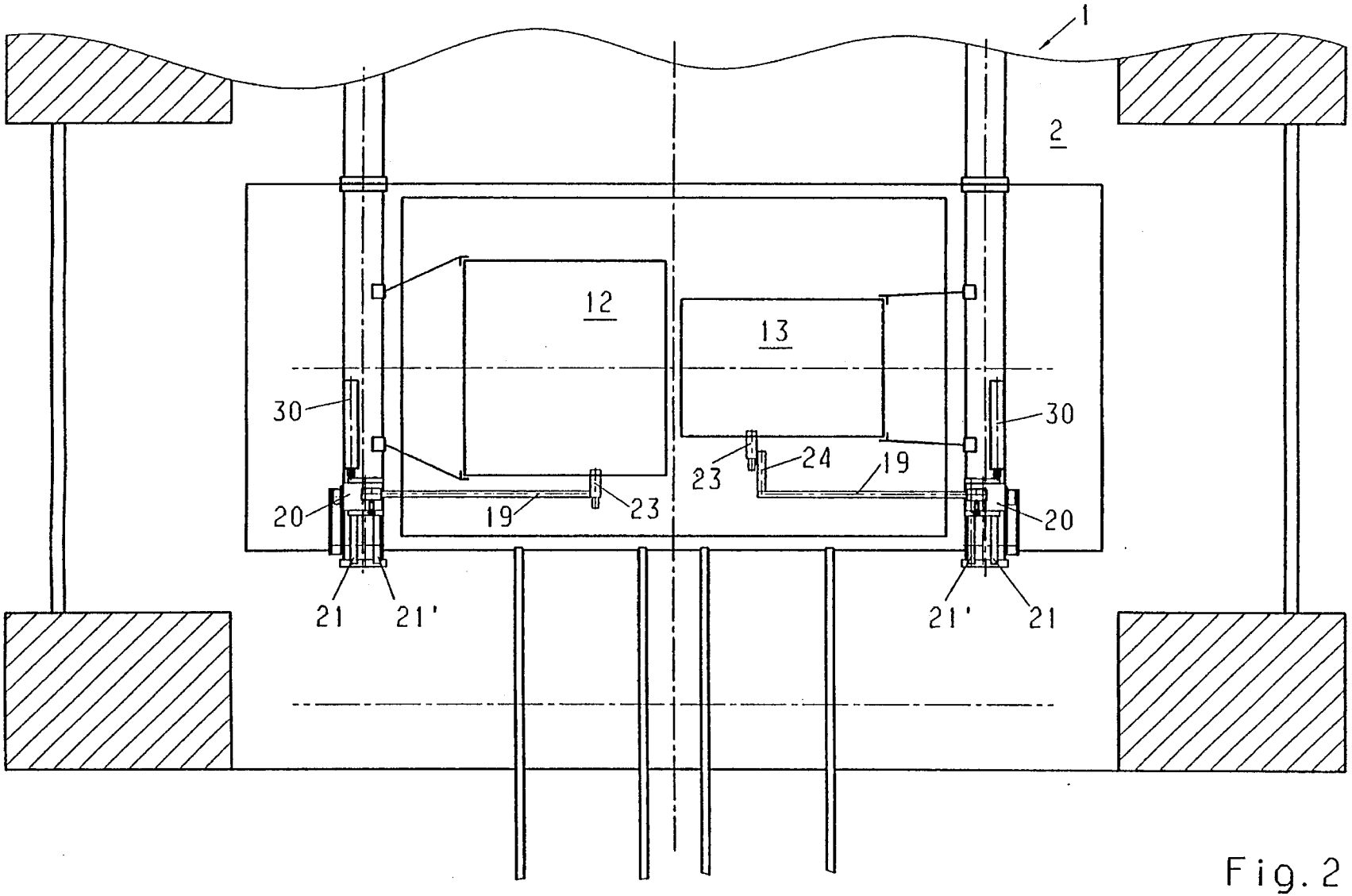
FIG. 2 shows an identical view according to FIG. 1 displaying the device according to the invention in the part removal setting.
Figure 3:
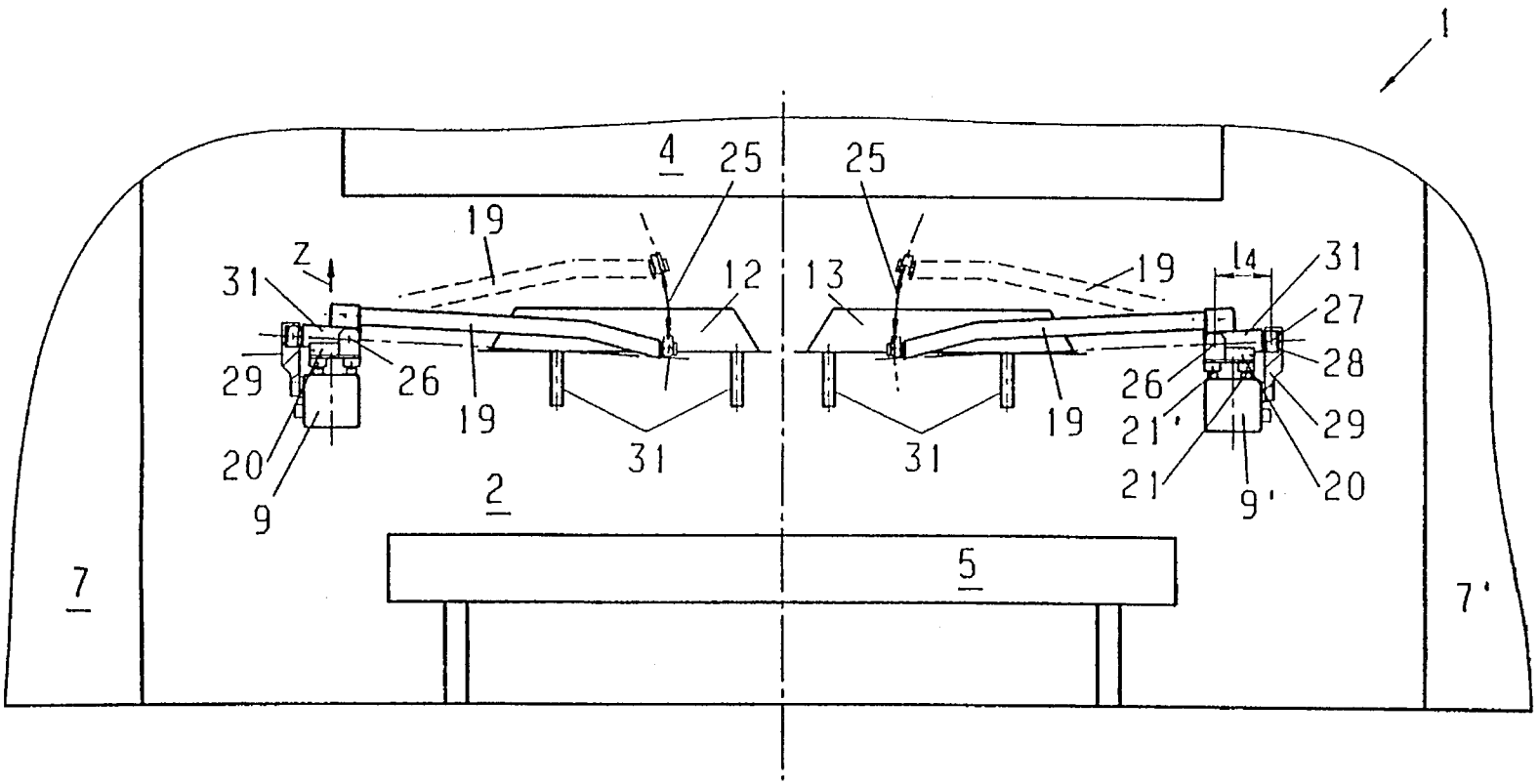
FIG. 3 shows a front view of the representation according to FIG. 4.

FIGS. 1 and 2 show the last die stage 2 of a multiple-die press 1 of this type in top view FIG. 3 is a corresponding front view viewed from the press end. Reference numeral 4 denotes a press ram, and reference numeral 5 is a press table for receiving a die (not represented in greater detail) of the die stage. The press table 5 is configured as a sliding table and can be withdrawn laterally from the press.

The die stage 2 is limited by the four press columns 6, 6' and 7, 7'.

The entire multiple-die press is passed through by two gripper rails 9, 9', which are also described as longitudinal transfer beams. As represented schematically in FIGS. 1 and 3, the longitudinal transfer beams 9, 9' are mounted so as to be respectively displaceable to and fro both in the longitudinal direction (x-axis), i.e. in the longitudinal direction of transport, and in the transverse direction thereto (y-axis). Furthermore, according to the representation in FIG. 3, the gripper rails can also be moved up and down, this being represented by the there-indicated z-axis. The longitudinal motion within the press is made in order to transport the workpieces from die stage to die stage. The gripper rails 9, 9' are respectively configured to form gripper rail segments having the dividing points 10, thereby enabling the gripper rail segments to be at least partially withdrawn, by means of the sliding table, whenever a die is changed.

In the die stage 2 there is located the workpiece 11 within a workpiece space. The workpiece 11 is configured as a double part and embraces two single parts 12, 13. These single parts are joined together, throughout their pass through the press up to the last die stage, by a connecting bar 14 or the like, thereby enabling the double part to be held, in a manner which is known per se, by laterally disposed gripper tongs 15, 16. In FIG. 1, two respective gripper tongs 15, 15' or 16, 16' are herein disposed to the side of the double part 11 and enclasp the workpiece at an appropriate spot. The gripper tongs are fastened to the gripper rails and perform the motions of the gripper rails 9, 9'. The workpiece 11, which is configured as a double part, is thereby able to be transported through the press, in half stage-steps, by means of the gripper rails, the three-dimensional motion of the gripper rails serving to grasp the workpiece in the die chamber and raise the workpiece from the bottom die. The longitudinal motion of the gripper rail then transports the raised workpiece to a vacant stage disposed between the press columns or from just such a vacant stage into the next press station. Prior to the execution of the press stroke, the gripper rails travel laterally out of the die chamber.

As represented in FIGS. 1 and 2, the workpiece 11, which is configured as a double part, is now set to be separated in the region of the connecting bar 14, in the last press stage 2, by means of the die, thereby producing two, no longer joined single parts 12, 13. In the onward transportation of these single parts 12, 13 to the subsequent depositing stage 8, 8', these single parts would sag downwards in the middle of the press and might render the transport of parts impossible.

In order to provide support to the separated single parts 12, 13, the transporting apparatus according to the invention envisages that on the gripper rails 9, 9' there is provided an additional part supporting apparatus 17, 18, which under-grips the divided parts 12, 13 and props these up for the transport step. In FIG. 1, this part supporting apparatus 17, 18 is shown in its initial setting. It respectively comprises a transverse arm 19, which is disposed transversely to the direction of transport (x-axis) and is mounted laterally in a slide 20. The slide 20, for its part, is mounted displaceably in the longitudinal direction of the press (x-axis) in two longitudinal guides 21, 21', the longitudinal guides 21, 21' being disposed on the gripper rails 9, 9'. The respective slide 20 can thus be moved over the length $l_1$ of the longitudinal guide rods 21, 21' relative to the respective gripper rail 9, 9'.

Figure 4:
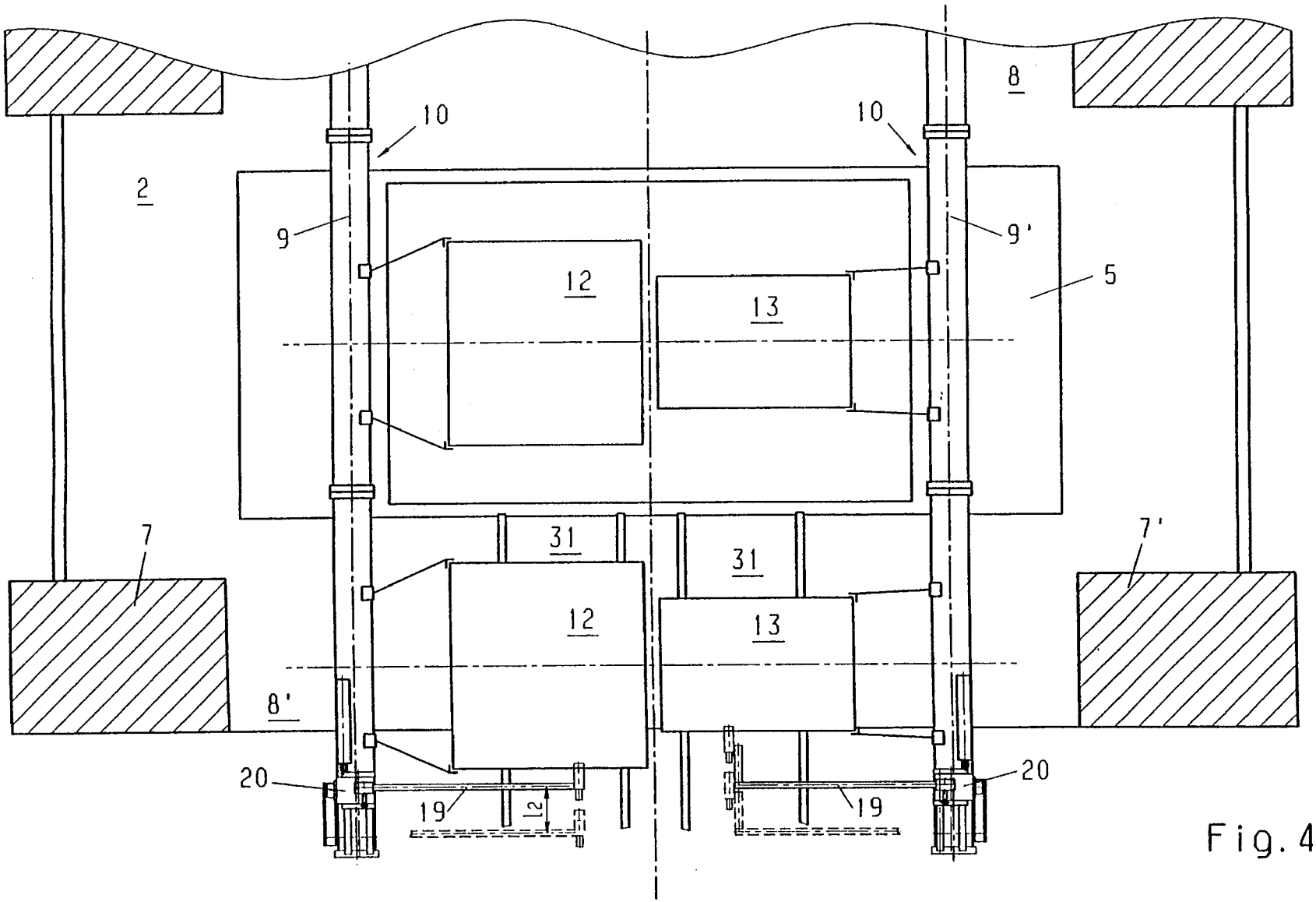
FIG. 4 shows a top view of the last die stage following the execution of a transport step and following depositing onto a conveyor belt and FIG. 5 shows a side view of the apparatus along the sectional line V—V in FIG. 1.

In order to under-grip the single workpiece 12, the left transverse arm 19 represented, by way of example, in FIG. 4 performs a longitudinal motion along the section $l_2$ and makes its way into the setting, represented in FIG. 2, in which it under-grips the left workpiece 12. At the end 22 of the gripper arm 19 there is herein provided a supporting or gripping device 23, which extends in the longitudinal direction of the press and travels, as a holding shoe or supporting arm, beneath the workpiece 12. The workpiece can however also be gripped otherwise from the side. Consequently, the device 23 can also be configured as a gripping tong or the like.

As represented in the figures, the right workpiece 13 exhibits different outer dimensions than the left workpiece 12. Insofar as the right slide 20, for the displacement of the right transverse arm 19, is intended to perform the same axial longitudinal displacement as the left slide 20 for the displacement of the left transverse arm 19, an additional telescopic arm or extension arm 24 is fastened, for the bridging of the differential spacing $l_3$, at the end 22 of the transverse arm 19, to enable the length of travel to be adapted.

In place of the additional telescopic arm 24, the right slide 20 can, where necessary, perform on the longitudinal guides 21 a longitudinal motion which is greater by the differential amount $l_3$.

FIG. 2 consequently shows the position of the two transverse arms 19, which are transported beneath the single workpieces 12, 13 by virtue of a longitudinal displacement of the slides 20 on the guide rods 21, 21'. The holders 23 hereupon under-grip or enclose the respective workpieces 12, 13.

Figure 5:
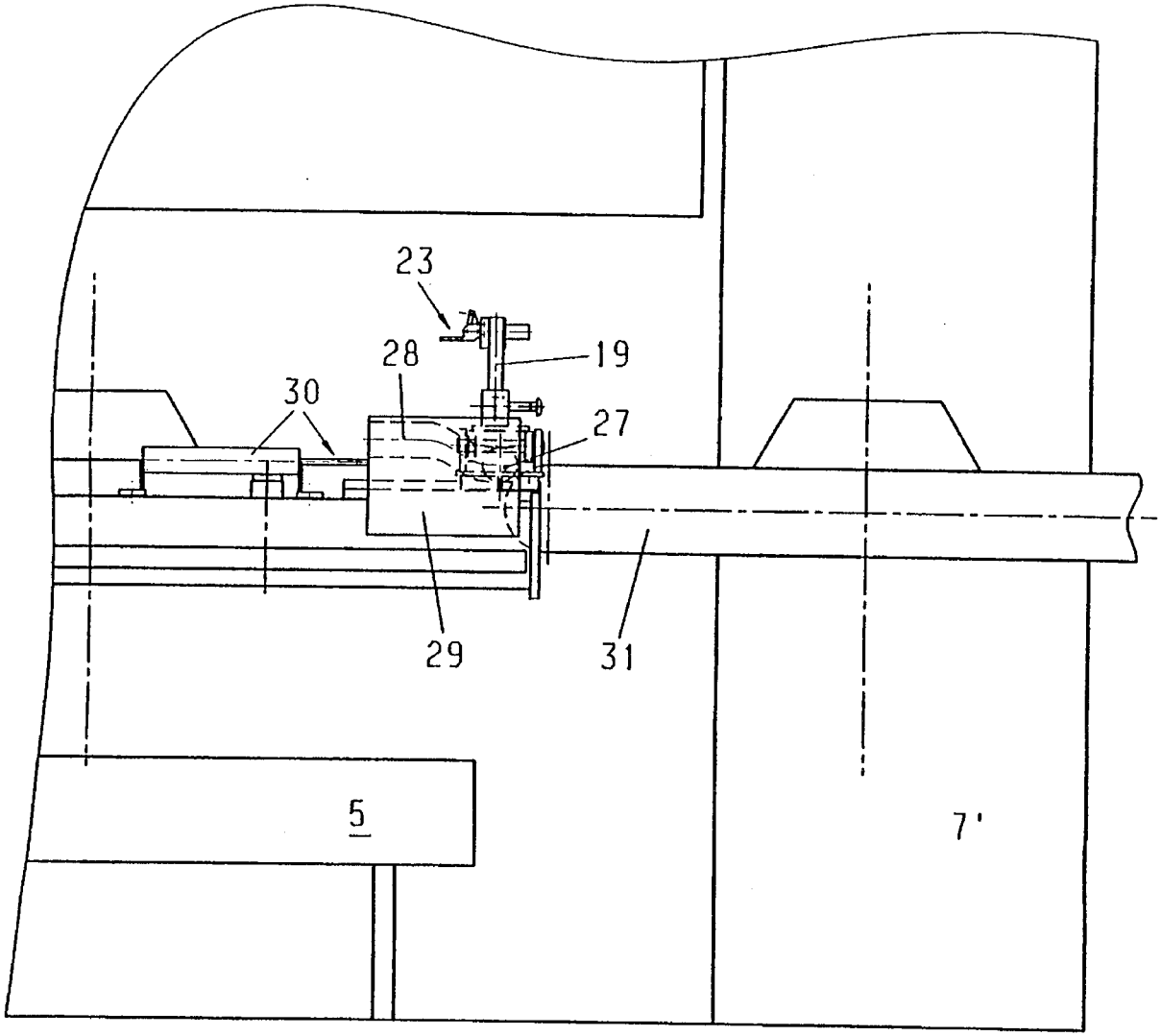

According to the representation shown in FIG. 3, the two transverse arms 19 are also able to perform an upwardly and downwardly directed motion, i.e. a swivel motion along the arrow 25, the pivot point 26 being situated in the region of the slide 20. This upwardly and downwardly directed motion serves properly to under-grip the workpiece and, upon the return travel of the gripper rails 9, 9' out of the depositing station, simultaneously, in the upwardly swiveled setting, to prevent collision with the deposited workpieces 12, 13. For this purpose, the lever arm 19 is lengthened beyond the pivot point 26 by an amount $1_4$ to form a rocker-shaped arrangement. The lengthened arm 31 exhibits, at its outer end, a guide roller 27, which is disposed in a connecting link guide 28 in a housing 29 fastened laterally to the gripper rail. In FIG. 5, the side view of this connecting link guide is once again represented. If the respective slide 20 is moved by means of the piston cylinder unit 30, relative to the gripper rail 9, 9', along the travel section $1_1$, then the guide roller 27, upon the motion in the direction of the workpiece, runs upwards in the connecting link guide 28, so that the lever arm 19 runs downwards in accordance with the rocker action and assumes the setting represented in FIG. 3 by an unbroken line. The connecting link 28 herein exhibits a shaping or course which corresponds to the required course of motion of the transverse arm 19, 19', with the aim, firstly, of making its way, from an initial position, beneath the workpiece (supporting and transporting position) and, secondly, upon its return travel, of getting out of the range of disturbance of the workpiece in order to travel over it. If the respective slide in FIG. 5 travels into the right-side position, i.e. away from the workpiece, then the guide roller is located in the connecting link guide in a lower position, as shown in the representation in FIG. 5, whereby the respective transverse am 19 swivels upwards along the arrow 25 into the dashed setting represented in FIG. 3. This upwardly swivelled position corresponds to the outer setting of the transverse arm 19 in FIG. 1.

FIG. 4 illustrates the execution of a transport step for transporting the respective workpieces 12, 13 into the depositing stage 8' disposed between the columns 7, 7'. After the workpiece 12, 13 has been deposited onto a transporting means 31, the two transverse arms 19 travel out of engagement with the workpieces 12, 13 by virtue of the described biaxial displacement in the form of a relative motion relative to the gripper rails 9, 9'. The transverse arms 19 then make their way into the setting shown in dashed representation.

The invention is not limited to the represented and described illustrative embodiment. On the contrary, it also embraces all expert refinements within the framework of the concept according to the invention.

I claim:

1. An apparatus for the transport of workpieces in a die press comprising a plurality of die stages, comprising:

at least first and second spaced apart gripper rails extending respectively in a longitudinal direction through said die stages and movable in three directions so as to grip, lift and feed the workpieces in the longitudinal direction between the die stage;

at least one tong fastened to the first gripper rail and projecting in a direction essentially perpendicular to the longitudinal direction of such rail and toward the second gripper rail, said at least one tong having an end for supporting a portion of a workpiece and for moving the workpiece from one die stage to another die stage; and at least one arm fastened to the first gripper rail, said arm projecting transversely from said gripper rail and having an end offset relative to the end of said at least one tong in a direction of the second gripper rail, said arm being so mounted that its end is movable in the longitudinal direction towards and away from the workpiece held by said tong so that the end of said arm can be placed in a position where it supports the workpiece at a position distal from the portion supported by the tong in the direction toward the second gripper rail.

2. An apparatus as defined in claim 1, wherein said first gripper rail includes a longitudinal guide having said arm fastened therein.

3. An apparatus as defined in claim 1, wherein said first gripper rail further comprises a slide movable in the longitudinal direction, said arm being mounted on and guided by said slide.

4. An apparatus as defined in claim 3, wherein said arm is pivotally mounted on said slide at a pivot point.

5. An apparatus as defined in claim 4, further comprising a connecting link guide attached to said first gripper rail, wherein said arm includes a segment projecting over the pivot point and having an end guided by said connecting link guide so that said arm pivots when it is moved in the longitudinal direction relative to said gripper rail.

6. An apparatus as defined in claim 1, further comprising one of a holding shoe, a collet and a gripper connected to the end of said arm and projecting in the longitudinal direction towards the workpiece.

7. An apparatus as defined in claim 6, wherein the end of said arm has an extension arm attached thereto and arranged in the longitudinal direction, said holding shoe being attached to said extension arm and being variably adjustable in the longitudinal direction.

8. An apparatus as defined in claim 1, wherein said arm has a telescopically displaceable length.

9. An apparatus as defined in claim 1, wherein said at least first and second gripper rails comprises two opposing gripper rails, and said at least one arm comprises an arm attached to each respective opposing gripper rail, each said arm being diversely adjustable relative to the other said arm.

10. An apparatus as defined in claim 9, wherein said die press includes a last die stage having said arms located therein.

11. An apparatus as defined in claim 1, wherein said die press includes a last die stage for a separation of the workpiece into at least two separate workpieces, said at least one arm comprising a plurality of arms each supporting and transporting a respective separate workpiece.

12. An apparatus as defined in claim 1, wherein said arm is at least one of displaceable and pivotable.

13. An apparatus for the transport of workpieces in a die press comprising a plurality of die stages, comprising:

at least first and second spaced apart gripper rails extending respectively in a longitudinal direction through said die stages and movable in three directions so as to grip, lift and feed the workpieces in the longitudinal direction between the die stages;

at least one tong fastened to the first gripper rail and projecting in a direction essentially perpendicular to the longitudinal direction of such rail and toward the second gripper rail, said at least one tong having an end for supporting a portion of a workpiece and for moving the workpiece from one die stage to another die stage; and at least one arm fastened to the first gripper rail, said arm projecting transversely from said gripper rail and having an end offset relative to the end of said at least one tong in a direction of the second gripper rail, said end having an extension arm attached thereto that is arranged in the longitudinal direction and that is variably extendable in the longitudinal direction, said at least one arm being so mounted that its end is movable in the longitudinal direction towards and away from the workpiece held by said tong so that the extension arm can be placed in a position where it supports the workpiece at a position distal from the portion supported by the tong in the direction toward the second gripper rail.

14. An apparatus for the transport of workpieces in a die press comprising a plurality of die stages, comprising:

at least first and second spaced apart gripper rails extending respectively in a longitudinal direction through said die stages and movable in three directions so as to grip, lift and feed the workpieces in the longitudinal direction between the die stages;

at least one tong fastened to the first gripper rail and projecting in a direction essentially perpendicular to the longitudinal direction of such rail and toward the second gripper rail, said at least one tong having an end for supporting a portion of a workpiece and for moving the workpiece from one die stage to another die stage; and at least one displaceable or pivotable arm fastened to the first gripper rail, said arm projecting transversely from said gripper rail and having an end offset relative to the end of said at least one tong in a direction of the second gripper rail, said arm being so mounted that its end is movable in the longitudinal direction towards and away from the workpiece held by said tong so that the end of said arm can be placed in a position where it supports the workpiece at a position distal from the portion supported by the tong in the direction toward the second gripper rail.

* * * * *